US010090574B2

(12) United States Patent
Wu

(10) Patent No.: US 10,090,574 B2
(45) Date of Patent: Oct. 2, 2018

(54) MICROSTRIP ISOLATION STRUCTURE FOR REDUCING CROSSTALK

(71) Applicant: Chia-Ho Wu, Tainan (TW)

(72) Inventor: Chia-Ho Wu, Tainan (TW)

( * ) Notice: Subject to any disclaimer, the term of this patent is extended or adjusted under 35 U.S.C. 154(b) by 92 days.

(21) Appl. No.: 14/991,212

(22) Filed: Jan. 8, 2016

(65) Prior Publication Data

US 2017/0062893 A1 Mar. 2, 2017

(30) Foreign Application Priority Data

Aug. 24, 2015 (TW) ..... 104127438 A

(51) Int. Cl.
*H01P 3/08* (2006.01)
*H01P 1/203* (2006.01)

(52) U.S. Cl.
CPC ..... *H01P 3/08* (2013.01); *H01P 1/2039* (2013.01); *H01P 3/081* (2013.01)

(58) Field of Classification Search
CPC ..... H01P 3/08; H01P 1/2039; H01P 3/081
USPC ..... 333/238
See application file for complete search history.

(56) References Cited

U.S. PATENT DOCUMENTS 5,027,088 A * 6/1991 Shimizu ..... H01P 3/081 333/1
9,615,446 B2 * 4/2017 Wu ..... H05K 1/0245
2008/0053694 A1 * 3/2008 Park ..... H05K 1/0219 174/350
2012/0133454 A1 * 5/2012 Wu ..... H01P 3/026 333/33

* cited by examiner

*Primary Examiner* — Stephen E Jones
*Assistant Examiner* — Scott S Outten
(74) *Attorney, Agent, or Firm* — WPAT, PC

(57) ABSTRACT

The present invention provides a microstrip isolation structure for reducing crosstalk, comprising a microstrip line and two grounded resistors. The microstrip line comprises a plurality of indentation structures arranged periodically. The two grounded resistors are connected to two ends of the microstrip line, respectively. The plurality of indentation structures are periodically arranged in a subwavelength configuration that a period length of the plurality of indentation structures is far smaller than a wavelength of a transmission signal generated by a crosstalk around the microstrip line, whereby impingement of electromagnetic wave is confined by the plurality of indentation structures.

4 Claims, 18 Drawing Sheets

MICROSTRIP ISOLATION STRUCTURE FOR REDUCING CROSSTALK

CROSS-REFERENCE TO RELATED APPLICATIONS

This application claims the benefit of Taiwan Patent Application Serial No. 104127438, filed Aug. 24, 2015, the subject matter of which is incorporated herein by reference.

BACKGROUND OF INVENTION

1. Field of the Invention

The present invention relates to a microstrip structure and, more particularly, to a microstrip structure for isolating adjacent transmission lines from each other so as to reduce the crosstalk interference between the transmission lines.

2. Description of the Prior Art

In recently years, with the package size of electronic products becoming smaller and signal transmission rate becoming higher in the high-frequency circuit or high-speed digital system, electronic circuits tend to be designed to be more intensive or can be operated at high microwave frequency. Accordingly, the crosstalk phenomenon between electronic circuits becomes more serious than ever before. When signals are transmitted via transmission channel, adjacent transmission lines will be interfered by each other due to electromagnetic coupling phenomenon; therefore, the interfered transmission lines may generate coupling voltage and current, which is so-called crosstalk. Excessive crosstalk may influence the efficiency of the system, or result in the mistrigger of the circuit thereby damaging the system. Besides, when designing a bent electronic circuit, engineers usually increase the interval between the adjacent microstrip lines, or increase the rising time or the falling time of the digital signals in order to reduce the crosstalk; however, the crosstalk still cannot be completely eliminated.

As the conventional methods cannot effectively eliminate the crosstalk occurring between the transmission lines, it is necessary to propose novel microstrip structure for isolating microstrip lines from each other thereby suppressing the crosstalk therebetween and reducing the mode conversion effect between differential mode and common mode.

SUMMARY OF THE INVENTION

The present invention provides an isolation structure for separating transmission lines. The isolation structure is formed by etching the lateral sides of a microstrip line to form periodic structure having subwavelength configuration, such as a plurality of indentation structures, for example, and connecting resistors to the microstrip line wherein the impedance of the resistors are matched with the impedance of the microstrip line.

The microstrip line can introduce the current distributed over the edges into indentation structures periodically formed along lateral sides of the microstrip line so as to form an approximately closed loop, which is favorable to increase the self-inductance of the circuit and confine the magnetic field around the microstrip transmission lines thereby effectively reducing the crosstalk due to the mutual inductance between the adjacent microstrip transmission lines.

The confinement effect of magnetic field is varied with the depth variation of the indentation structures, and it can also influence the isolation effect between microstrip transmission lines. Since the coupling amount between the microstrip line having periodic subwavelength configuration and microstrip transmission line is quite few and the resistors coupled to the microstrip line having periodic subwavelength configuration can effectively conduct electrical signals into ground, the microstrip line of the present invention can effectively separate two microstrip transmission lines or strip-typed transmission lines from each other. The microstrip line having periodic subwavelength configuration can simply be a microstrip line having a single grounded plane or be a strip-typed structure that are grounded at top and bottom sides.

Conventionally, the periodic structure formed in microstrip circuits is usually for band stop; however, it is not so practical because of its long length. In addition, another purpose of the periodic structure in conventional microstrip circuits is to serve as a proper R-L structure for coupling adjacent circuits. Therefore, the concept of the present invention is different from the above two conventional arts.

As the above-mentioned purposes of the periodic structure in conventional microstrip circuits are deeply rooted in those skilled in the art, it is difficult to the one having ordinary skilled in the art to use the periodic subwavelength structure as an isolation circuit for separating the transmission lines. Additionally, the circuit design software used by them usually cannot support the kinds of circuits; therefore, it is inconceivable for them to use the microstrip line having periodic subwavelength structures as the isolation structure for separating the transmission lines thereby reducing the crosstalk.

Currently, there are two common methods to depress crosstalk effect. One is to increase the turns in a differential pair or single-ended line to reduce crosstalk effect; however, it may increase the common mode signal rapid in the differential pair, which is unfavorable to the operation of the whole circuit. The other is to install additional ground lines through the via holes between adjacent circuits; however, it could result in two obvious shortcomings including, firstly, the areas of the circuits cannot be effectively deceased, and secondly, the ground lines can only block electrical field, but cannot effectively depress the mutual inductance between lines. In addition, the aforesaid two conventional methods will almost lose effectiveness when the frequency or speed rate is getting higher and higher.

However, in the present invention, circuitous paths are sculptured on the surface of conductors such that the edge current distributed over the circuitous paths will form a quasi loop for effectively confining the magnetic field and depressing the crosstalk effect resulting from the mutual inductance. Since the coupling effect between the periodic subwavelength structure of the present invention and conventional microstrip transmission lines is extremely small, it can be utilized as an isolation structure to reduce mutual inductance between two signal transmission lines. The isolation will become stronger if the frequency of the signal is higher.

Since the period length is much smaller than wavelength, its working frequency is far away from the band gap and the coupling with the conventional transmission line is extremely low. The present invention is applicable to high-frequency microwave circuit and high-speed circuit; in particular, the present invention can effectively block the mutual interference in an intensive circuit. In addition, the microstrip isolation structure of the present invention can also be utilized to isolate the differential pair for preventing coupling between the differential pair and reducing the mode conversion effect between differential mode and common mode.

One of the primary objects of the present invention is to provide a microstrip isolation structure for reducing crosstalk effect, which comprises a microstrip line having a plurality of indentation structures periodically formed at lateral sides thereof, and two resistors coupled to two ends of the microstrip line, respectively. The plurality of indentation structures have periodic arrangement with a subwavelength configuration that a period length of the plurality of indentation structures is far smaller than a wavelength of a transmission signal generated by a crosstalk effect around the microstrip line, whereby impingement of electromagnetic wave is isolated by the plurality of indentation structures.

BRIEF DESCRIPTION OF THE DRAWINGS

The present invention will now be specified with reference to its preferred embodiment illustrated in the drawings, in which.

DESCRIPTION OF THE PREFERRED EMBODIMENT

Figure 1:
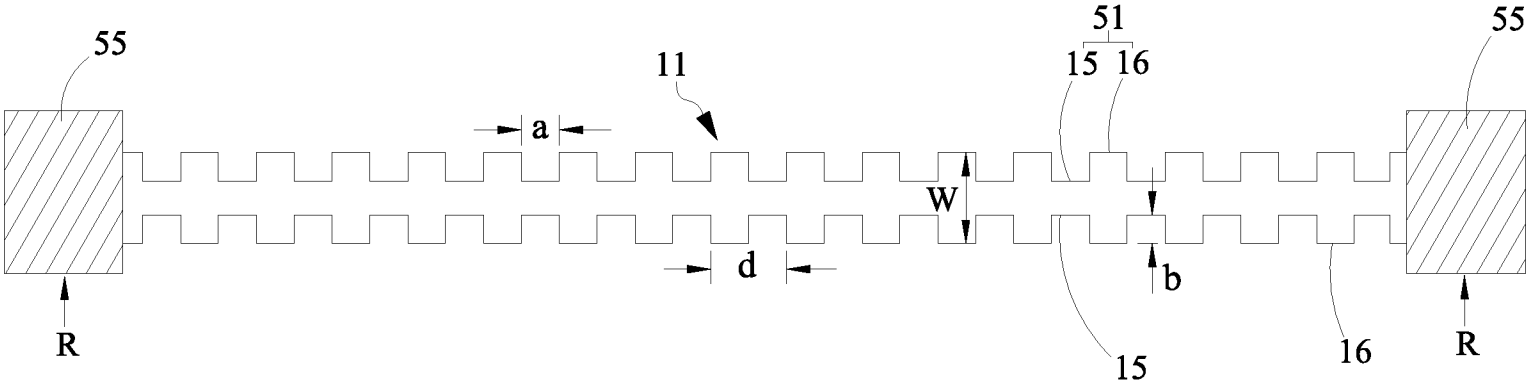
FIG. 1 illustrates a first embodiment of the microstrip isolation structure having a plurality of indentation structures formed along two lateral sides of the microstrip.

The invention disclosed herein is directed to microstrip isolation structure for reducing crosstalk effect. In the following description, numerous details corresponding to the aforesaid drawings are set forth in order to provide a thorough understanding of the present invention so that the present invention can be appreciated by one skilled in the art, wherein like numerals refer to the same or the like parts throughout.

The present invention provides a microstrip isolation structure for reducing a crosstalk effect. In a first embodiment shown in FIG. 1, the microstrip isolation structure comprises a microstrip line 11 and two resistors 55. The microstrip line 11 has a plurality of indentation structures 51 with periodic arrangement. One resistor 55 is connected to one end of the microstrip line 11 and the other resistor 55 is connected to the other end of the microstrip line 11, wherein the two resistors 55 are grounded and are impedance matched with the microstrip line 11.

The plurality of indentation structures 51 are periodically formed at two lateral sides of the microstrip line 11 in a subwavelength configuration. In the present embodiment, the plurality of indentation structures are configured by a plurality of rectangle recesses 15 and a plurality of rectangle projections 16 alternately connected to each other. On the microstrip line 11 having subwavelength configuration, an opening width of each recess 15 is notated as "a", a width of the microstrip line is notated as "w", a period length of the subwavelength configuration is notated as "d", and the depth of each recess 15 is notated as "b".

Figure 2:
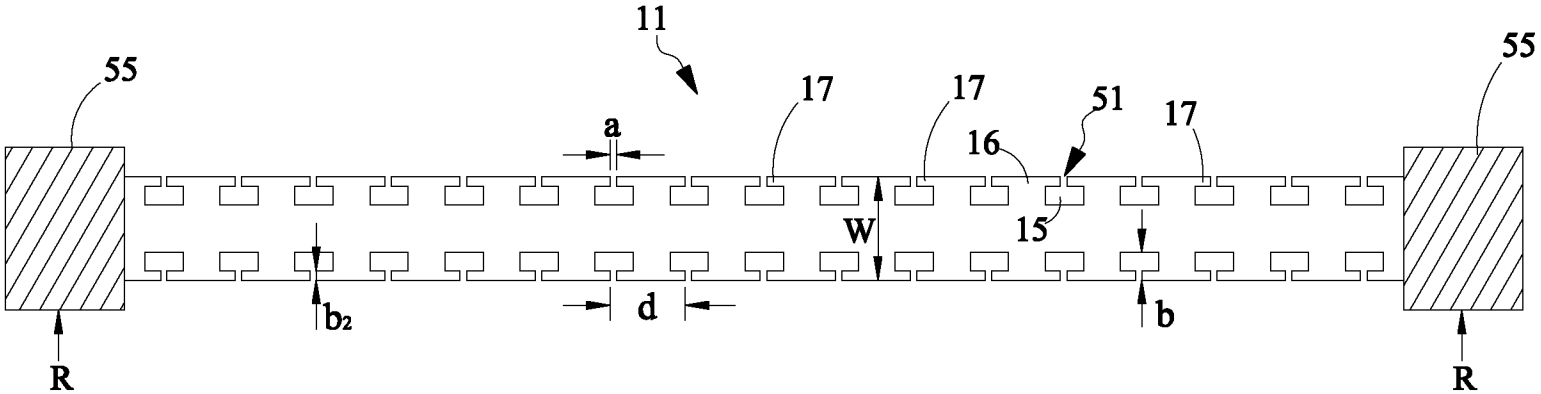
FIG. 2 illustrates a second embodiment of the microstrip isolation structure having indentation structure with two extension parts respectively extending in opposite directions.

The second embodiment of microstrip isolation structure for reducing crosstalk is shown in FIG. 2, in which the indentation structures 51 formed at two lateral sides of the microstrip isolation structure has bi-directional extension parts. In the present embodiment, the microstrip isolation structure comprises a microstrip line 11 and two resistors 55. The microstrip line 11 has a plurality of indentation structures 51 with periodic arrangement. One end of the microstrip line 11 is connected to one resistor 55 while the other end of the microstrip line 11 is connected to the other resistor 55. The another ends of two resistors 55 are grounded and are impedance matched with the microstrip line 11. The plurality of indentation structures 51 are formed at two corresponding lateral sides of the microstrip line 11 in a subwavelength configuration.

The indentation structures 51 are configured by a plurality of rectangle recesses 15 and a plurality of rectangle projections 16 alternately connected to each other so as to form the periodic indentation structures 51. Each rectangle projection 16 has two first extension parts 17 oppositely and parellelly extending toward a center of an opening of two adjacent rectangle recesses 15 oppositely connected to the rectangle projection 16. In the present embodiment, on the microstrip line 11 having subwavelength configuration, an opening width of each indentation structure 51 is notated as "a", the width of the microstrip line 11 is notated as "w", a period length of the subwavelength configuration of the microstrip line 11 is notated as "d", the depth of each indentation structure 51 is notated as "b", and the thickness of the extension part 17 is notated as "$b_2$".

Figure 3:
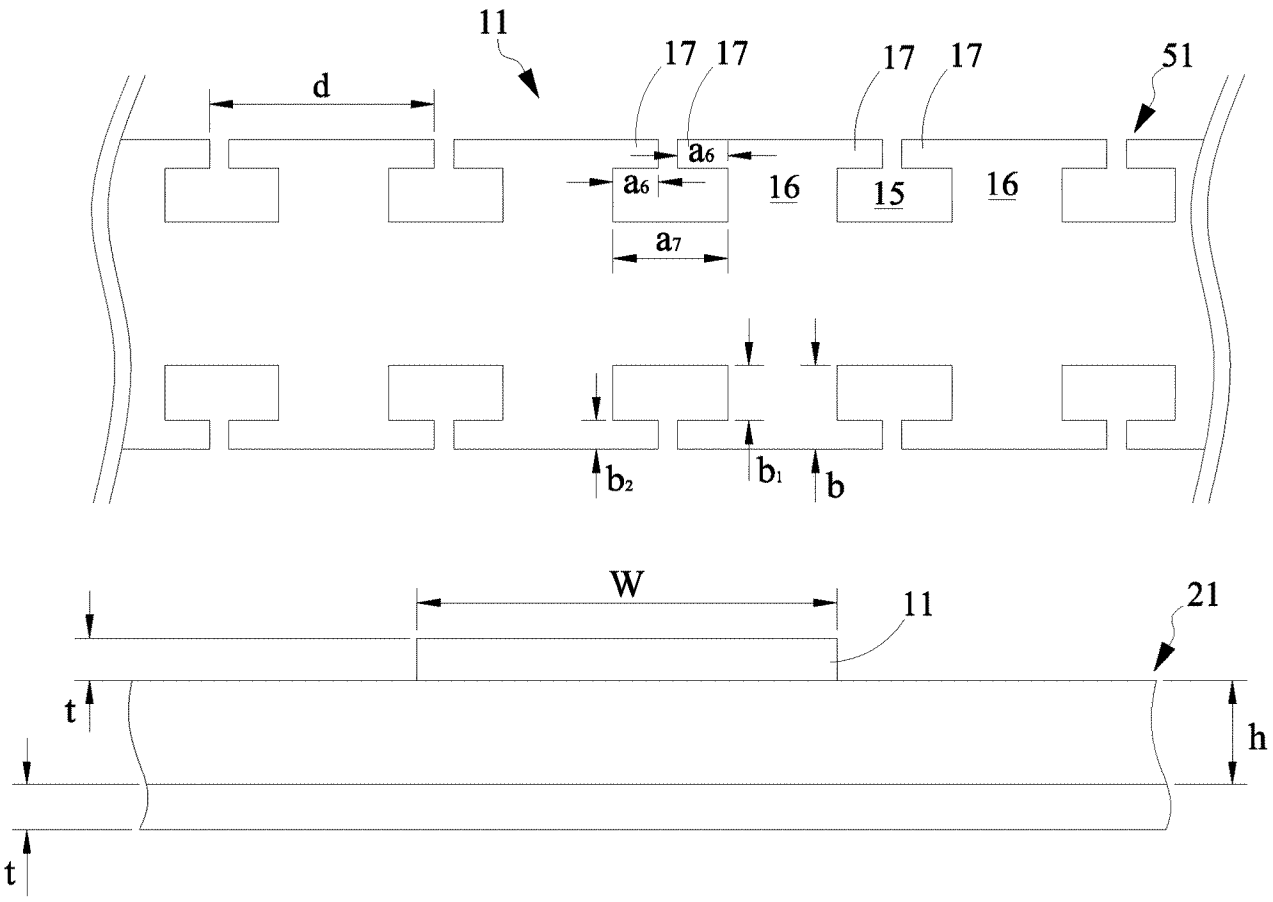
FIG. 3 illustrates top and lateral views of the indentation structure with two extension parts respectively extending in opposite directions according to the second embodiment of the present invention.

Please refer to FIG. 3, which illustrates a detail enlarged view of partial indentation structures of the microstrip line 11 shown in FIG. 2, wherein the upper part of the FIG. 3 is a top view of the enlarged part of indentation structures and the bottom part is a cross-sectional view of the enlarged part of the indentation structures. In the FIG. 3, notation "$b_2$" represents thickness of the extension part 17, notation "$b_1$" represents a depth inside the indentation structure 51 defined between the extension part 17 and bottom of the recess 15 of the indentation structure 51, notation "$a_6$" represents a length of the extension part 17, and notation "$a_7$" represents a width of the bottom of the recess 15 of the indentation structure 51. Please refer to the bottom part of the FIG. 3, from the bottom layer to the top layer, wherein a thickness of the grounded metal layer formed at bottom is notated as "t", a height of a substrate layer 21 having dielectric constant $\in_r$ is notated as "h", a width of microstrip line 11 is notated as "w", and a thickness of metal layer of the microstrip line 11 is notated as "t".

Figure 4:
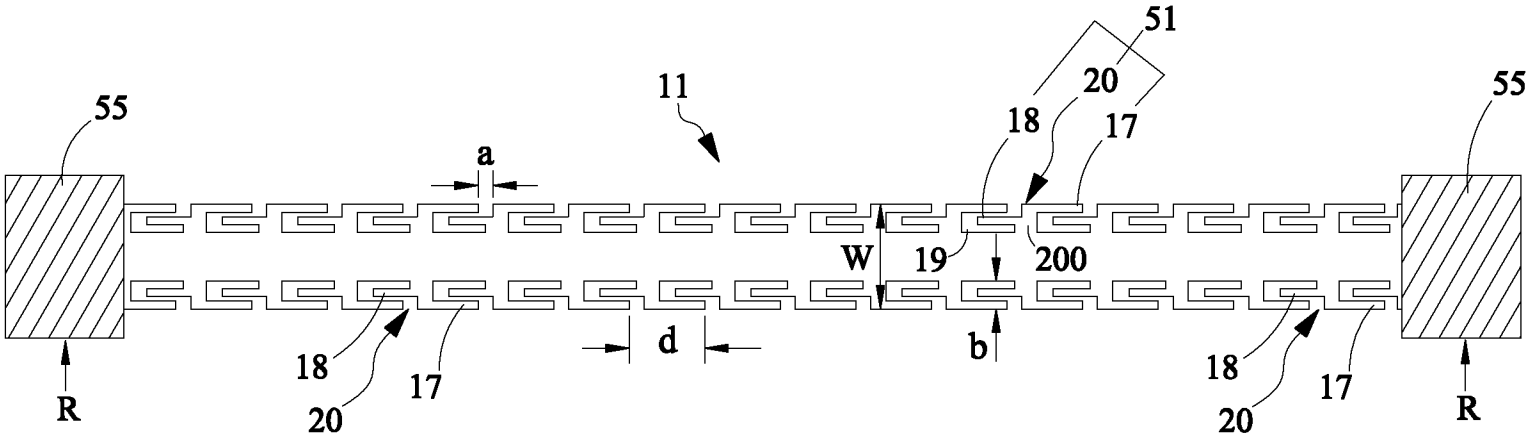
FIG. 4 illustrates a third embodiment of the microstrip isolation structure having comb structures periodically formed along two lateral sides of the microstrip line.

The third embodiment of the microstrip isolation structure having comb structure is illustrated as FIG. 4, wherein the microstrip isolation structure comprises a microstrip line 11 and two resistors 55. The microstrip line 11 comprises a plurality of indentation structures 51 wherein one end of the microstrip line 11 is connected to one resistor 55 while the other end of the microstrip line 11 is connected to the other resistor 55. The two resistors 55 are grounded and are impedance matched with the microstrip line 11. The plurality of indentation structures 51 are periodically formed at two corresponding lateral sides of the microstrip line 11 in a subwavelength configuration.

Each indentation structure 51 has a recess 19 and a Z-shaped projection 20 connected to the recess 19, wherein each Z-shaped projection 20 further comprises a first extension part 17 connected to the projection body 200, and a second extension part 18 connected to a middle section of the projection body 200, wherein the first extension part 17 is extended toward an opening of the adjacent recess 19 connected to a first side of the Z-shaped projection 20 and the second extension part 18 is extended toward an opening of the other adjacent recess connected to a second side of the Z-shaped projection 20 and an extending direction of the first extension part 17 is opposite of an extending direction of the second extension part 18. In the present embodiment, on the microstrip line 11 having subwavelength configuration, an opening width of the recess 19 in each indentation structure 51 is notated as "a", a period length of the indentation structures 51 is notated as "d", and a depth of the recess 19 of the indentation structure 51 is notated as "b".

Figure 5:
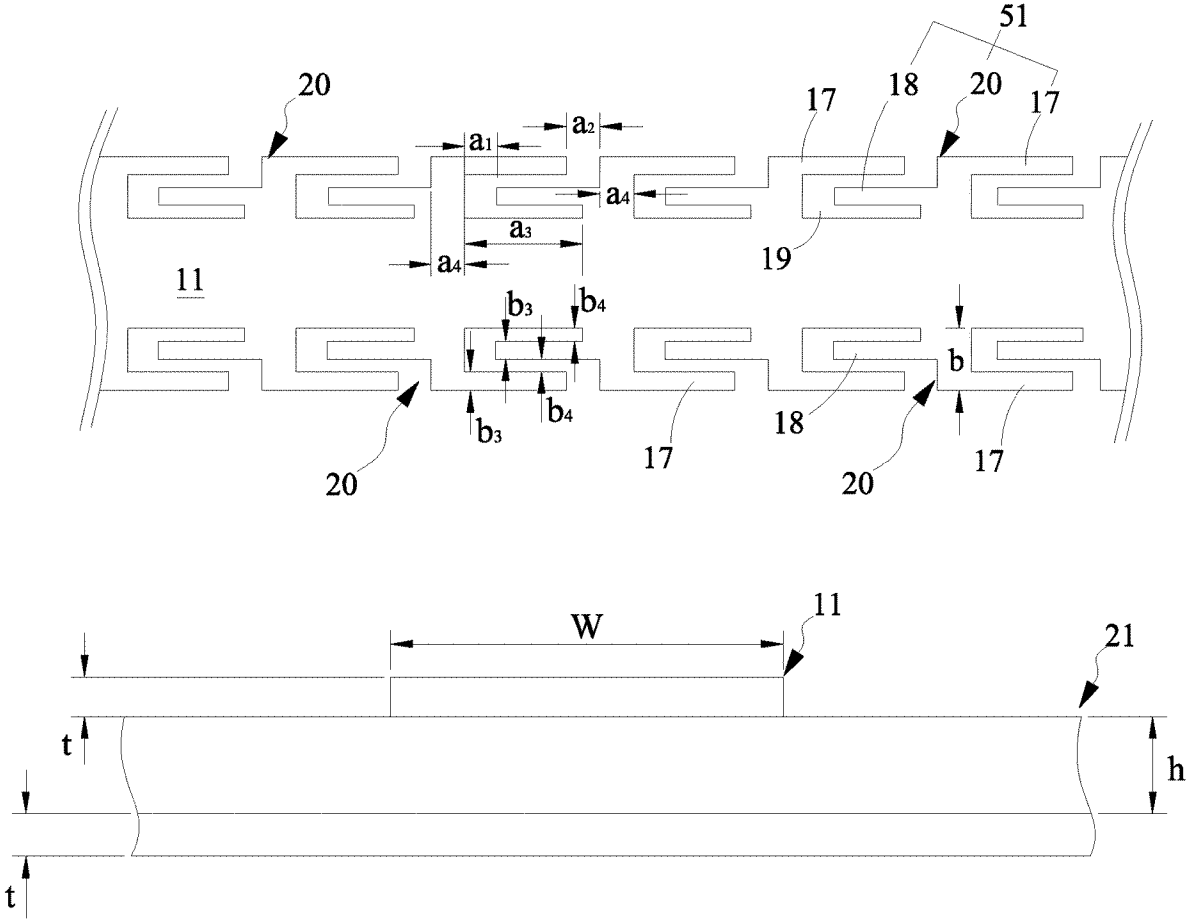
FIG. 5 illustrates top and lateral view of the comb structures according to the third embodiment of the present invention.

Please refer to FIG. 5, which illustrates a detail enlarged view of a part of indentation structures having comb structure shown in FIG. 4. The upper part of the FIG. 5 is a top view of the enlarged part of indentation structures 51, wherein notation "$b_3$" represents a thickness of the second extension part 18 or the first extension part 17 along direction of depth of the indentation structure 51, notation "$b_4$" represents a distance between the second extension part 18 and the first extension part 17 and also represents a distance between the second extension part 18 and the bottom of the recess 19. The opening width "a" shown in FIG. 4 is notated as "$a_2$" correspondingly shown in FIG. 5 and a distance between the end of the second extension part 18 and the lateral side of the recess 19 is notated as "$a_1$". A width of the bottom of the recess 19 is notated as "$a_3$". A distance between one lateral side of the opening $a_2$ and a bottom of the first extension part 17 is notated as "$a_4$". In addition, the bottom part of FIG. 5 illustrates a cross-sectional view of the microstrip isolation structure, from the bottom layer to the top layer, it includes a grounded metal layer having thickness "t", and a thickness of a substrate 21 having dielectric constant $\in_r$ which is notated as "h". The top layer is the microstrip line 11 having width "w". The thickness of the metal layer of the microstrip line 11 is notated as "t".

Figure 6:
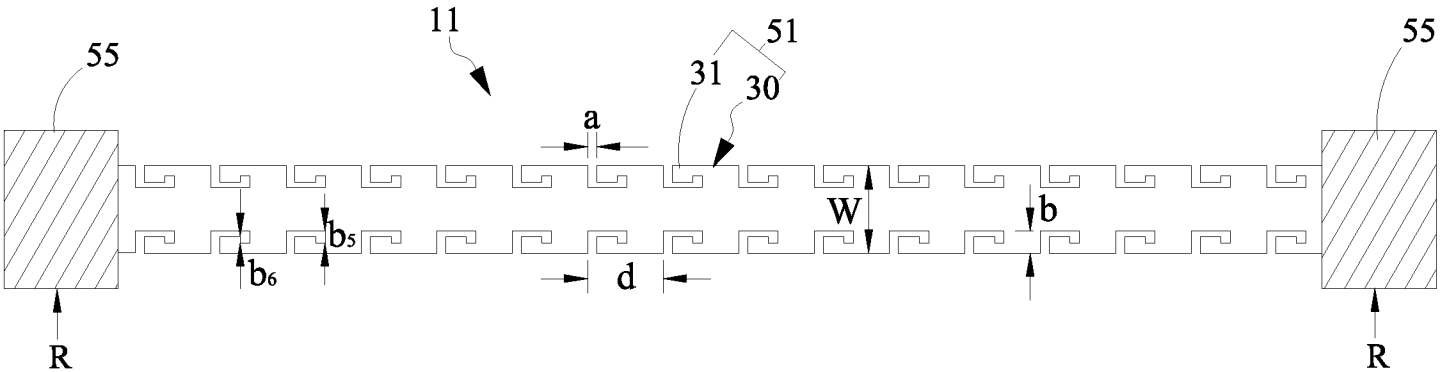
FIG. 6 illustrates a fourth embodiment of the microstrip isolation structure having indentation structures with J-shaped projections formed along two lateral sides of the microstrip.

Please refer to FIG. 6, which illustrates a fourth embodiment where each indentation structure 51 has a J-shaped projection 30. In the present embodiment, the microstrip isolation structure comprises a microstrip line 11 and two resistors 55. The microstrip line 11 comprises a plurality of indentation structures 51 arranged periodically. One resistor 55 is connected to the one end of the microstrip line 11 while the other resistor 55 is connected to the other end of the microstrip line 11. The two resistors 55 are grounded and are impedance matched with the microstrip line 11. The plurality of indentation structures 51 are formed at the two lateral sides of the microstrip line 11 in a subwavelength configuration. Each indentation 51 comprises a J-shaped projection 30 having a hook part 31 bending toward recess bottom of the indentation structure 51. On the microstrip line 11, an opening of each indentation structure 51 is notated as "a", a width of the microstrip line 11 is notated as "w", a period length of microstrip line 11 is notated as "d", a depth of the recess of the indentation structure 51 is notated as "b", a distance between the bottom of the recess to the inner boundary of the hook part 31 is notated as "$b_5$", and a height of a protrusion of the hook part 31 is notated as "$b_6$".

Figure 7:
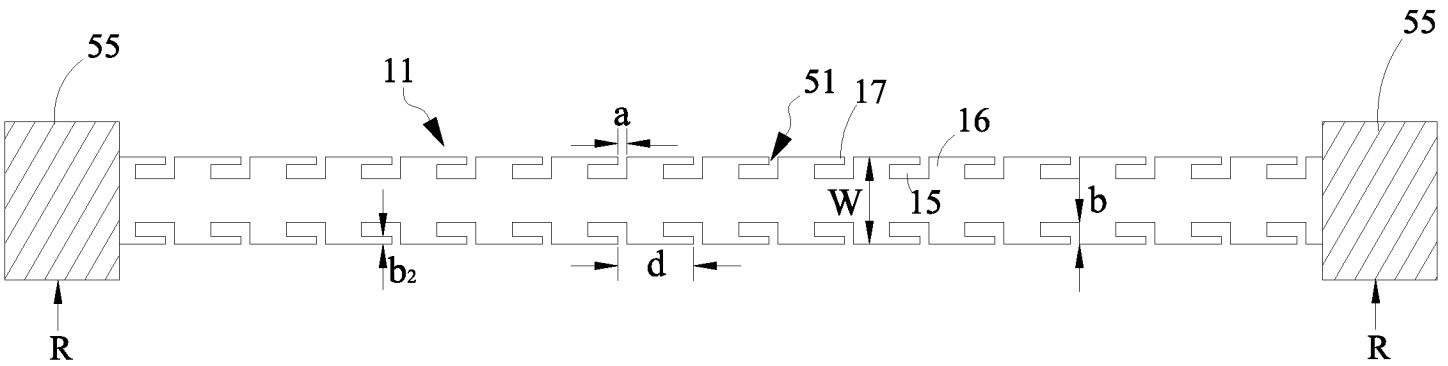
FIG. 7 illustrates a fifth embodiment of the microstrip isolation structure having indentation structures with first extension parts formed along two lateral sides of the microstrip.

Please refer to FIG. 7, which illustrates a fifth embodiment where each indentation structure 51 has a first extension part along one direction. In the present embodiment, the microstrip isolation structure comprises a microstrip line 11 and two resistors 55. The microstrip line 11 comprises a plurality of indentation structures 51 having a periodic arrangement. One resistor 55 is connected to the one end of the microstrip line 11 while the other resistor 55 is connected to the other end of the microstrip line 11. The two resistors 55 are grounded and are impedance matched with the microstrip line 11. The plurality of indentation structures 51 are formed at the two lateral sides of the microstrip line 11 in a subwavelength configuration.

Each indentation 51 comprises a rectangle recess 15 and a rectangle projection 16 connected thereto such that the plurality of indentation structures 51 are configured by a plurality of rectangle recesses 15 and a plurality of rectangle projections 16 alternately connected to each other. Each rectangle projection 16 further has a first extension part 17 extending parallelly toward opening of the rectangle recess 15. On the microstrip line 11 having subwavelength configuration, an opening of each indentation structure 51, i.e. an opening of the rectangle recess 15, is notated as "a", a width of the microstrip line 11 is notated as "w", a period length of the plurality of indentation structures 51 is notated as "d", a depth of the rectangle recess 15 is notated as "b" and a thickness of the first extension part 17 is notated as "$b_2$".

Figure 8:
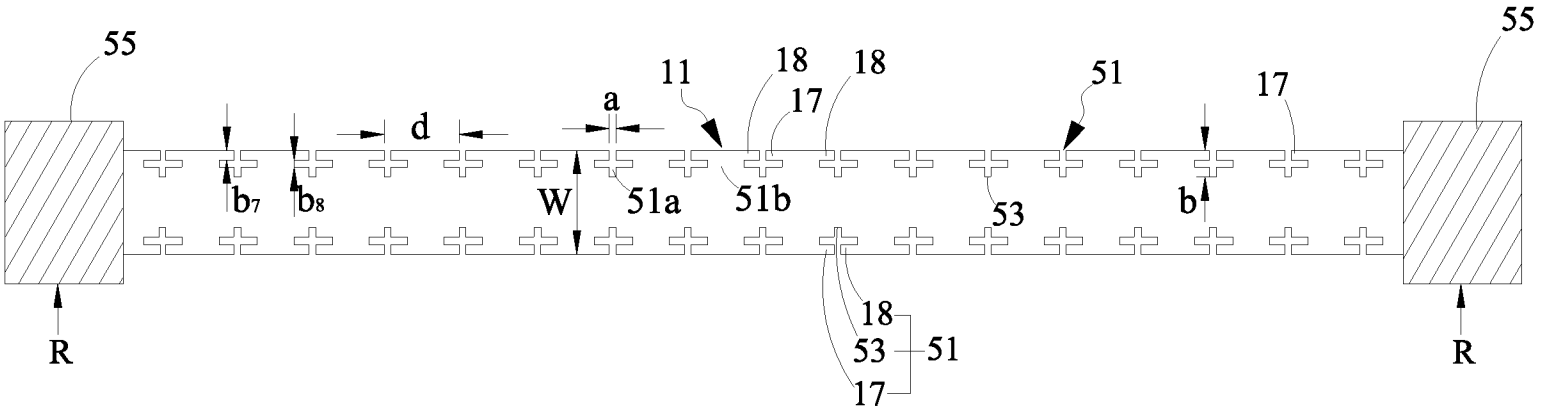
FIG. 8 illustrates a sixth embodiment of the microstrip isolation structure having indentation structures with cross-shaped recess formed along two lateral sides of the microstrip.

Please refer to FIG. 8, which illustrates a sixth embodiment where each indentation structure 51 has a cross-shaped recess. In the present embodiment, the microstrip isolation structure comprises a microstrip line 11 and two resistors 55. The microstrip line 11 comprises a plurality of indentation structures 51 having periodic arrangement. One resistor 55 is connected to the one end of the microstrip line 11 while the other resistor 55 is connected to the other end of the microstrip line 11. The two resistors 55 are grounded and are impedance matched with the microstrip line 11. The plurality of indentation structures 51 are formed at the two lateral sides of the microstrip line 11 in a subwavelength configuration.

The plurality of indentation structures 51 are configured by a plurality of recesses 51*a* and a plurality of projections 51*b* alternately connected to each other, wherein each recess 51*a* has an extending recess 53 and each projection 51*b* has a first and a second extension parts 17 and 18 respectively extending toward opening of two adjacent recesses 51*a* oppositely connected to a first and a second sides of the projection 51*b* such that the recess 51*a* is formed as the cross-shaped recess. On the microstrip line 11 having subwavelength configuration, an opening of each indentation structure 51, i.e. an opening of the cross-shaped recess, is notated as "a", a width of the microstrip line 11 is notated as "w", a period length of microstrip line 11 is notated as "d", a depth of the extending recess 53 is notated as "b", a thickness of the first or second extension parts 17 or 18 are notated as "$b_7$", and a width of a horizontal slot formed the cross-shaped recess is notated as "$b_8$".

Figure 9:
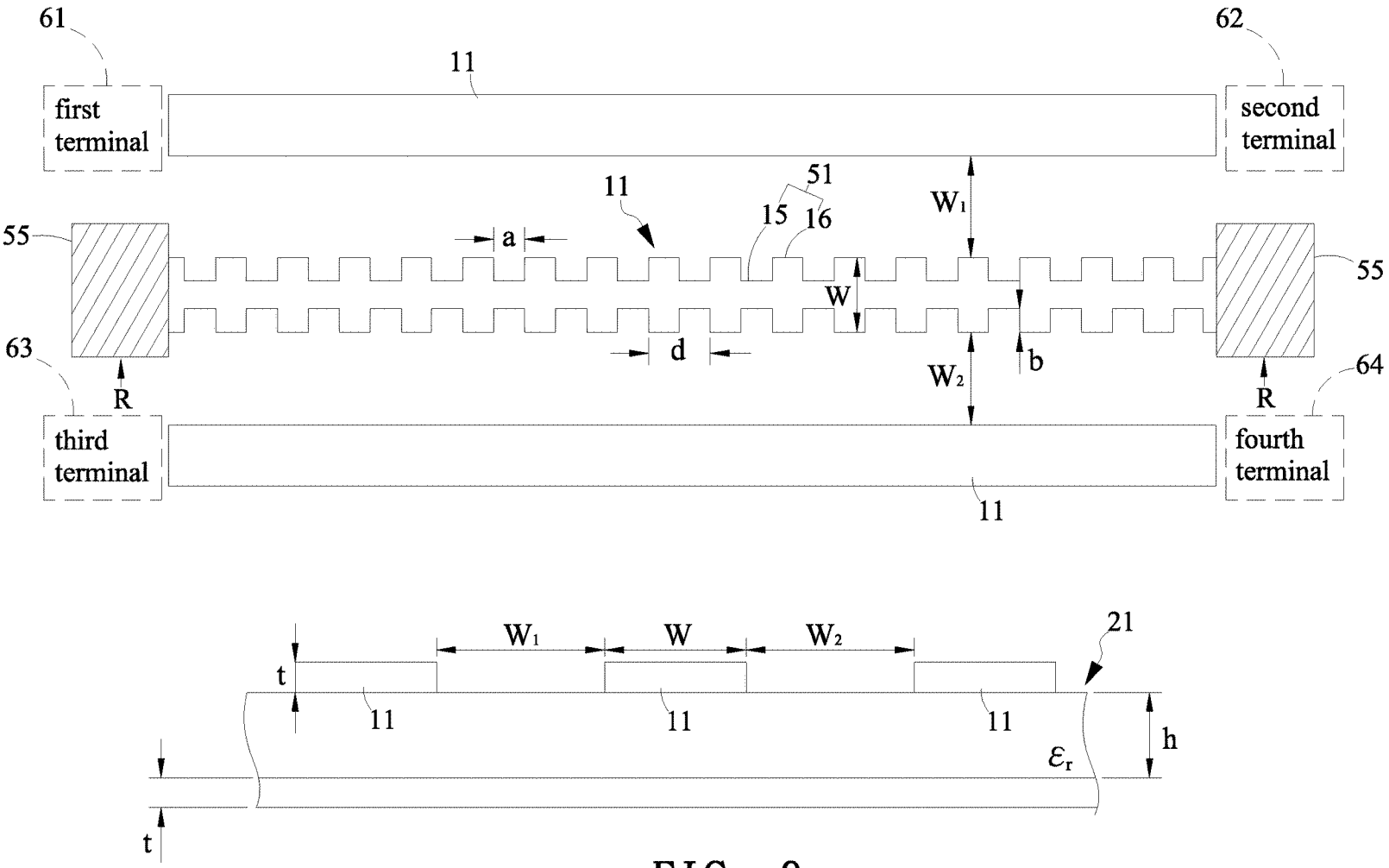
FIG. 9 illustrates a top view and a lateral views of microstrip isolation structure having indentation structures with rectangle recesses and rectangle projections and arranged between two microstrip transmission lines according to a seventh embodiment of the present invention.

Please refer to FIG. 9, which illustrates a seventh embodiment where a microstrip isolation structure is disposed between two microstrip transmission lines 11. One end of the upper microstrip transmission line 11 has a first terminal 61 while the other end has a second terminal 62. Likewise, the one end of the lower microstrip transmission line 11 has a third terminal 63 while the other end has the fourth terminal 64. If there has no isolation measure between the two microstrip transmission lines 11, the crosstalk effect induced by the electromagnetic energy generated from the upper microstrip line 11 will interfere with the lower microstrip transmission line seriously. However, when the microstrip isolation structure is disposed between the two transmission lines 11, the crosstalk effect between the two transmission lines 11 will be effectively isolated. Accordingly, the microstrip isolation structure of the present invention did have effect on isolating and reducing crosstalk due to the electromagnetic energy generated from the upper and lower microstrip transmission lines 11.

Please refer to FIG. 9, which illustrates an application using the microstrip isolation structure shown in FIG. 1 for reducing the crosstalk effect, wherein the indentation structure 51 has the rectangle recess 15 and the rectangle projection 16. The upper part of the FIG. 9 is a top view wherein notation "a" represents opening of each rectangle recess 15, notation "d" represents a period length of the indentation structures 51, notation "b" represents a depth of the rectangle recess 15, "$W_1$" represents a distance between the microstrip isolation structure and upper microstrip transmission line 11, and "$W_2$" represents a distance between the microstrip isolation structure and lower microstrip transmission line 11.

Please refer to the bottom part of the FIG. 9, from the bottom layer to the top layer, it includes a grounded metal layer having thickness notated as "t", a substrate layer 21 with dielectric constant $\in_r$ having a height notated as "h", the center microstrip line 11, i.e. the microstrip isolation structure, having a width notated as "w", and a thickness notated as "t". It is noted that the microstrip isolation structure, i.e. the center microstrip line 11, in the seventh embodiment shown in FIG. 9 can be any one of the isolation structure shown in FIGS. 1 to 8 or FIGS. 11 to 15.

Figure 10:
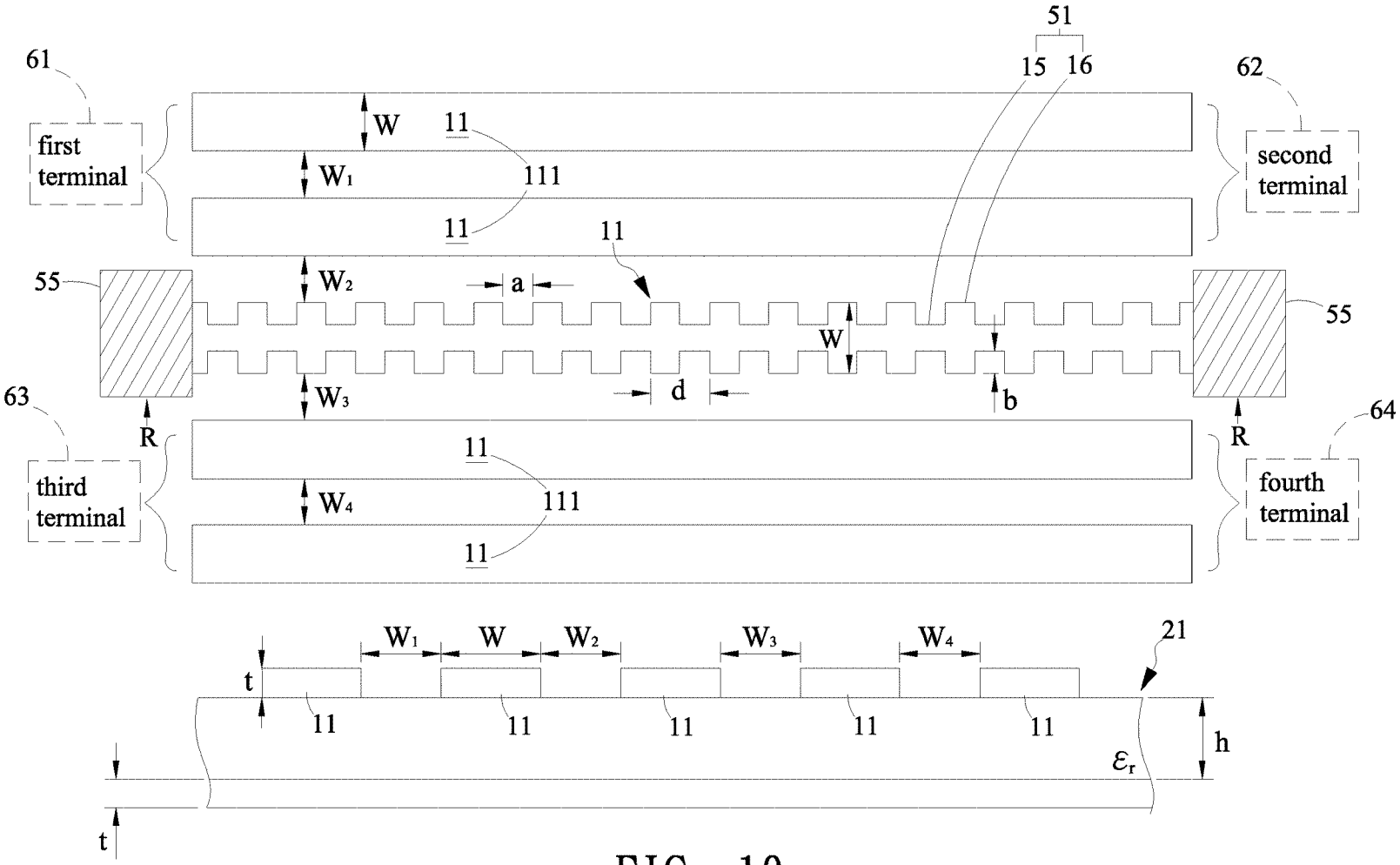
FIG. 10 illustrates a top and lateral views of the microstrip isolation structure arranged between two differential pairs of microstrip transmission lines according to an eighth embodiment of the present invention.

Please refer to FIG. 10, which illustrates an eighth embodiment where a microstrip isolation structure is disposed between two differential microstrip transmission pairs 111. Each differential microstrip transmission pair comprises two microstrip transmission lines, wherein one microstrip transmission line 11 (first microstrip transmission line) transmits first transmission signal, and the other microstrip transmission line 11 (second microstrip transmission line) transmits second transmission signal. The first and second transmission signals are complementary signals having 180-degree phase difference from each other.

The differential microstrip transmission pair 111 arranged at upper side has a first terminal 61 and a second terminal 62 at two ends while the differential microstrip transmission pair 111 arranged at the lower side has a third terminal 63 and fourth terminal 64. It is noted that if there has no isolation measure arranged between the two differential microstrip pairs 111, the crosstalk due to the electromagnetic energy generated from the upper differential microstrip transmission pair 111 will obviously interfere with the lower differential microstrip transmission pair 111. However, if the microstrip isolation structure is arranged between the two differential microstrip transmission pairs 111, the crosstalk effect will be eliminated effectively; therefore, the microstrip isolation structure of the present invention did have effect on isolating and reducing crosstalk due to the electromagnectic energy.

Please refer to FIG. 10, which illustrates a microstrip isolation structure for reducing crosstalk effect in which each indentation structure 51 comprises a rectangle recess 15 and rectangle projection 16. The upper part of the FIG. 10 is a top view, wherein notation "a" represents opening of each rectangle recess 15, notation "d" represents a period length of the indentation structures 51, notation "b" represents a depth of the rectangle recess 15, "$W_1$" represents a distance between the differential microstrip transmission lines 11, "$W_2$" represents a distance between the upper microstrip isolation structure 11 and one adjacent differential microstrip transmission line of the upper differential microstrip transmission pair 111, "$W_3$" represents a distance between the microstrip isolation structure 11 and one adjacent differential microstrip transmission line of the lower differential microstrip transmission pair 111, and "$W_4$" represents a distance between the lower differential microstrip transmission lines 11.

Please refer to the bottom part of the FIG. 10, from the bottom layer to the top layer, wherein a thickness of the grounded metal layer formed at bottom is notated as "t", a height of a substrate layer 21 having dielectric constant $\in_r$ is notated as "h", a width of center microstrip line 11, i.e. the microstrip isolation structure, is notated as "w", and a width of each differential microstrip transmission line is notated as "w". The two differential microstrip transmission pairs 111 are formed at the top layer wherein each microstrip transmission line 11 is a metal layer having thickness notated as "t". In addition to the microstrip isolation structure illustrated in present embodiment, it is noted that the microstrip isolation structure, i.e. the center microstrip line 11, in the eighth embodiment shown in FIG. 10 can be any one of the isolation structure shown in FIGS. 1 to 8 or FIGS. 11 to 15.

Figure 11:
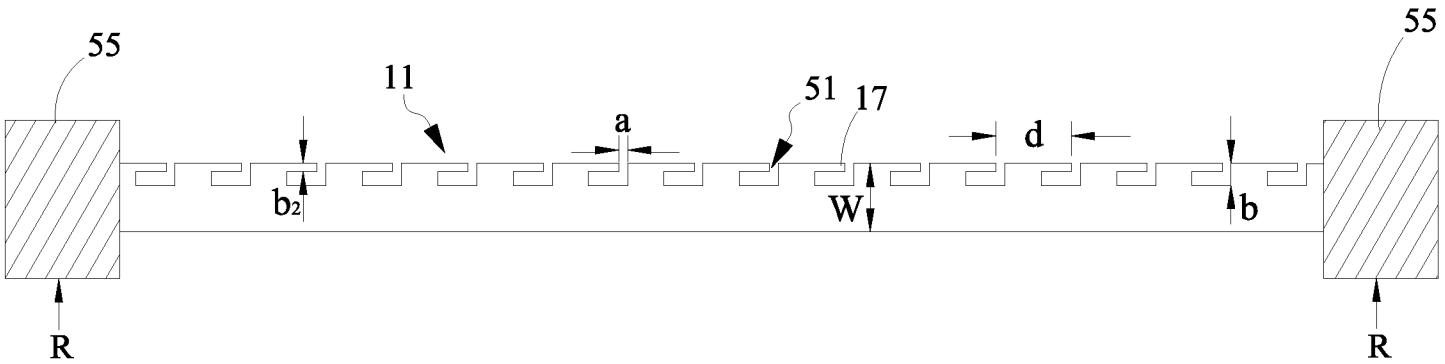
FIG. 11 illustrates a ninth embodiment where indentation structures with first extension parts are formed along a single side of the microstrip line.

Please refer to FIG. 11, which illustrates a ninth embodiment of the present invention where each indentation structure 51 has a first extension part extending along one single direction. In the present embodiment, the microstrip isolation structure comprises a microstrip line 11 and two resistors 55. The microstrip line 11 comprises a plurality of indentation structures 51 having periodic arrangement. One resistor 55 is connected to the one end of the microstrip line 11 while the other resistor 55 is connected to the other end of the microstrip line 11. The two resistors 55 are grounded and are impedance matched with the microstrip line 11. The plurality of indentation structures 51 are formed at one lateral side of the microstrip line 11 in a subwavelength configuration. Basically, the ninth embodiment is similar to the aforesaid fifth embodiment, whereas the different part is that the indentation structures 51 are formed at single side of the microstrip line 11 in the ninth embodiment, while the indentation structures 51 are formed at two lateral side of the microstrip line 11 in the fifth embodiment.

Figure 12:
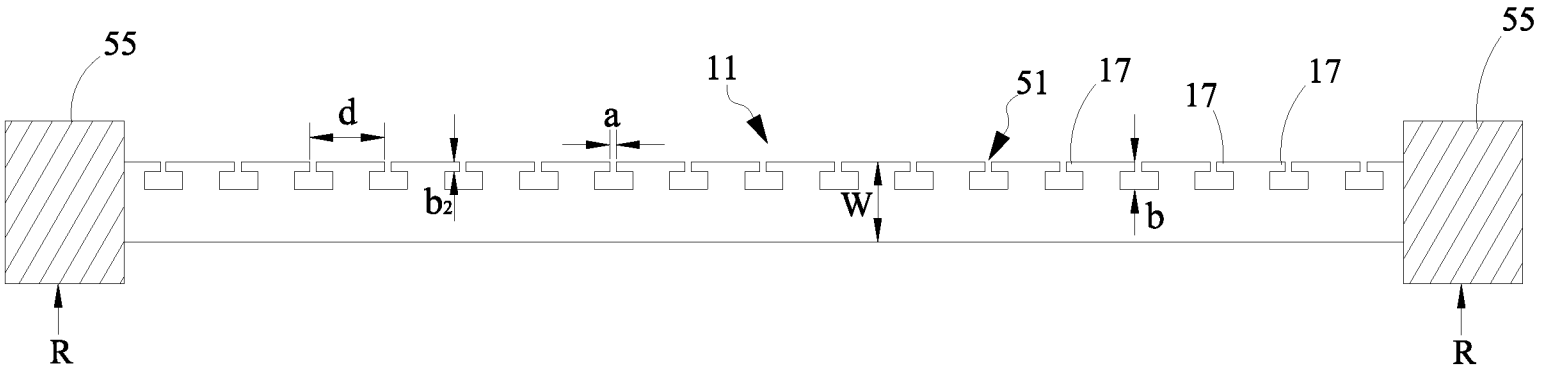
FIG. 12 illustrates a tenth embodiment where indentation structures with two first extension parts respectively extending in opposite directions are formed along a single side of the microstrip line.

Please refer to FIG. 12, which illustrates a tenth embodiment of the present invention where each indentation structure 51 has a first extension part extending along two opposite directions. In the present embodiment, the microstrip isolation structure comprises a microstrip line 11 and two resistors 55. The microstrip line 11 comprises a plurality of indentation structures 51 having periodic arrangement. One resistor 55 is connected to the one end of the microstrip line 11 while the other resistor 55 is connected to the other end of the microstrip line 11. The two resistors 55 are grounded and are impedance matched with the microstrip line 11. The plurality of indentation structures 51 are formed at one lateral side of the microstrip line 11 in a subwavelength configuration. Basically, the tenth embodiment is similar to the aforesaid second embodiment, and the different part is that the indentation structures 51 are formed at single side of the microstrip line 11 in the tenth embodiment, while the indentation structures 51 are formed at two lateral sides of the microstrip line 11 in the second embodiment.

Figure 13:
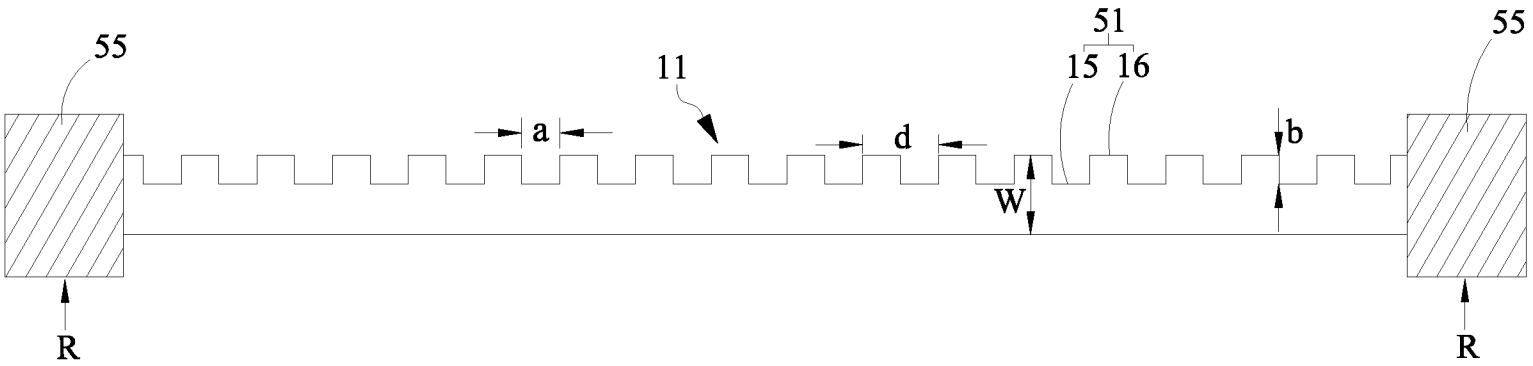
FIG. 13 illustrates an eleventh embodiment where indentation structures having rectangle recesses and rectangle projections alternately connected to each other are formed along a single side of the microstrip line.

Please refer to FIG. 13, which illustrates an eleventh embodiment of the present invention where each indentation structure 51 has rectangle recess 15 and a rectangle projection 16. In the present embodiment, the microstrip isolation structure comprises a microstrip line 11 and two resistors 55. The microstrip line 11 comprises a plurality of indentation structures 51 having periodic arrangement. One resistor 55 is connected to the one end of the microstrip line 11 while the other resistor 55 is connected to the other end of the microstrip line 11. The two resistors 55 are grounded and are impedance matched with the microstrip line 11. The plurality of indentation structures 51 are formed at one lateral side of the microstrip line 11 in a subwavelength configuration. Basically, the indentation structures shown in eleventh embodiment are similar to the aforesaid first embodiment, whereas the different part is that the indentation structures 51 are formed at single side of the microstrip line 11 in the eleventh embodiment, while the indentation structures 51 are formed at two lateral sides of the microstrip line 11 in the first embodiment.

Figure 14:
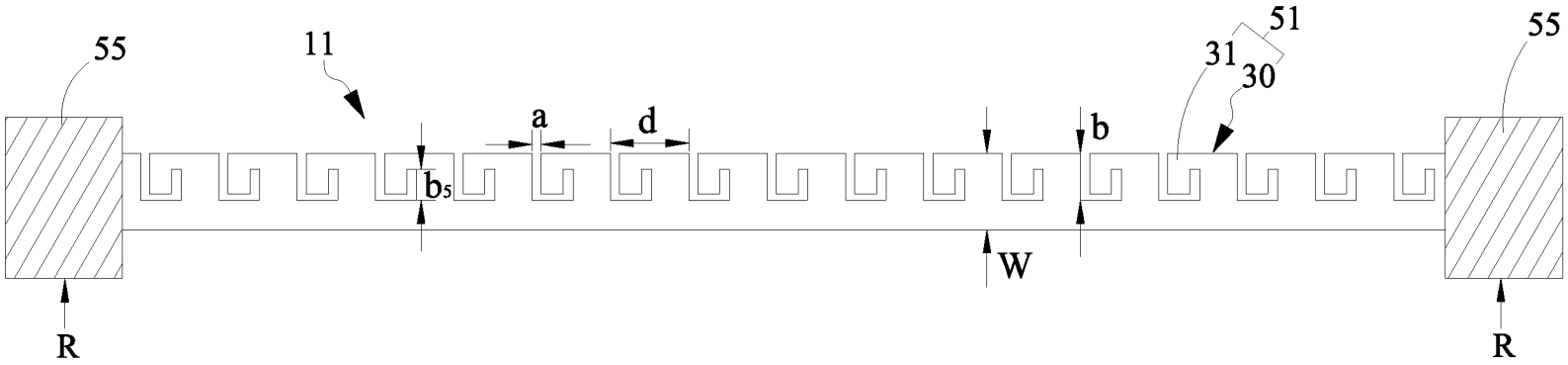
FIG. 14 illustrates a twelfth embodiment of indentation structure having J-shaped projection formed along a single side of the microstrip line.

Please refer to FIG. 14, which illustrates a twelfth embodiment of the present invention where each indentation structure 51 has a J-shaped projection 30. In the present embodiment, the microstrip isolation structure comprises a microstrip line 11 and two resistors 55. The microstrip line 11 comprises a plurality of indentation structures 51 having periodic arrangement. One resistor 55 is connected to the one end of the microstrip line 11 while the other resistor 55 is connected to the other end of the microstrip line 11. The two resistors 55 are grounded and are impedance matched with the microstrip line 11. The plurality of indentation structures 51 are formed at one lateral side of the microstrip line 11 in a subwavelength configuration. Basically, the indentation structures shown in twelfth embodiment are similar to the aforesaid fourth embodiment, and the different part is that the indentation structures 51 are formed at single side of the microstrip line 11 in the twelfth embodiment, while the indentation structures 51 are formed at two lateral sides of the microstrip line 11 in the fourth embodiment.

Figure 15:
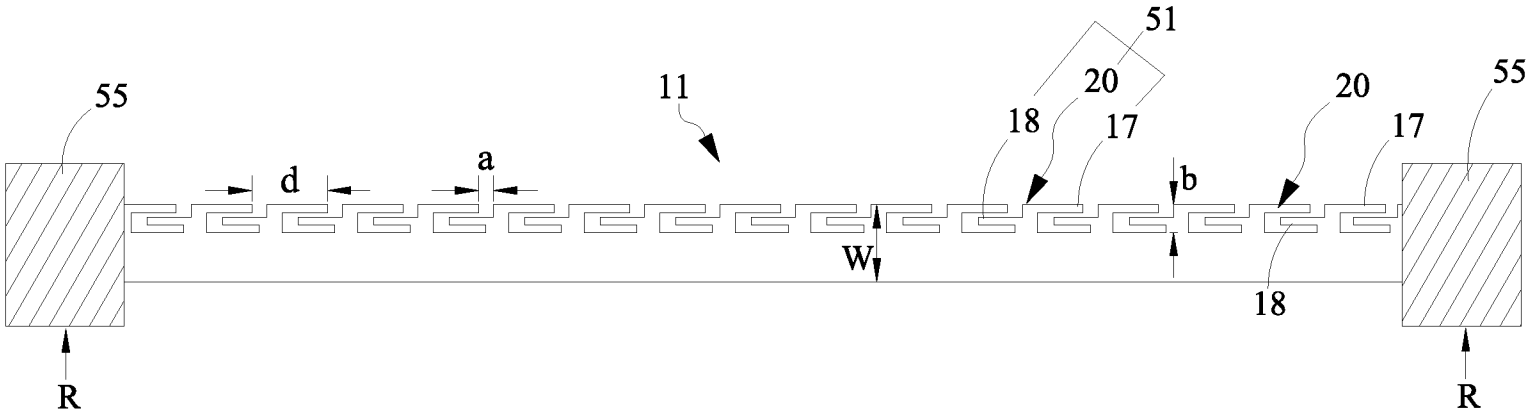
FIG. 15 illustrates a thirteenth embodiment of indentation structures having comb structures formed along a single side of the microstrip line.

Please refer to FIG. 15, which illustrates a thirteenth embodiment where each indentation structure 51 has a comb structure. In the present embodiment, the microstrip isolation structure comprises a microstrip line 11 and two resistors 55. The microstrip line 11 comprises a plurality of indentation structures 51 having periodic arrangement. One resistor 55 is connected to the one end of the microstrip line 11 while the other resistor 55 is connected to the other end of the microstrip line 11. The two resistors 55 are grounded and are impedance matched with the microstrip line 11. The plurality of indentation structures 51 are formed at one lateral side of the microstrip line 11 in a subwavelength configuration. Basically, the indentation structures shown in thirteenth embodiment are similar to the aforesaid third embodiment, and the different part is that the indentation structures 51 are formed at single side of the microstrip line 11 in the thirteenth embodiment, while the indentation structures 51 are formed at two lateral sides of the microstrip line 11 in the third embodiment.

The microstrip isolation structure of the present invention is provided for reducing crosstalk effect by a plurality of indentations having subwavelength configuration periodically formed at the at least one lateral side of the microstrip line, wherein the subwavelength configuration is that a period length of the plurality of indentation structures is far smaller than a wavelength of a transmission signal generated by a crosstalk effect around the microstrip line so that the plurality of indentation structures are capable of eliminating the impingement of electromagnetic wave as well as isolating the electromagnetic field so that externally generated crosstalk effect can be effectively reduced or eliminated.

It is noted that the source for generating crosstalk effect can be a single-ended transmission line or differential pair transmission lines. In the embodiments shown in FIGS. 9 and 10, the transmission lines generating crosstalk effect are conventional microstrip transmission lines without structures formed on the lateral sides thereof. In addition, alternatively, the transmission line or differential transmission pairs generating crosstalk effect can also be microstrip transmission line or differential microstrip transmission pair having a plurality of indentation structures with subwavelength configuration that are periodically formed on at least one lateral side of each microstrip transmission line. It is noted that the source for generating crosstalk effect is not limited to the microstrip transmission line or differential microstrip transmission pair. For example, the external source may be any signal source. Accordingly, the external source for generating crosstalk effect may be microstrip transmission line, differential microstrip transmission pair, or any signal source. Furthermore, the resistors 55 respectively connected to the two ends of the microstrip line 11 are grounded and are impedance matched with the microstrip line 11 so that the crosstalk or impingement of the electromagnetic energy can be grounded through the impedance matched resistors 55 thereby achieving objectives of reducing crosstalk and restraining the impingement of electromagnetic wave.

The layout of abovementioned microstrip line 11 can be, but should not be limited to, linear type, arc type, or nearly closed ellipse, circle, triangle, rectangle, or rhombus. It is noted that the microstrip isolation structure having microstrip line 11 and two resistors 55 in the present invention can be formed on a circuit board for effectively reducing and isolating crosstalk effect and the impingement of electromagnetic wave between different signal sources such as microstrip line, or differential microstrip pair, for example.

Figure 16:
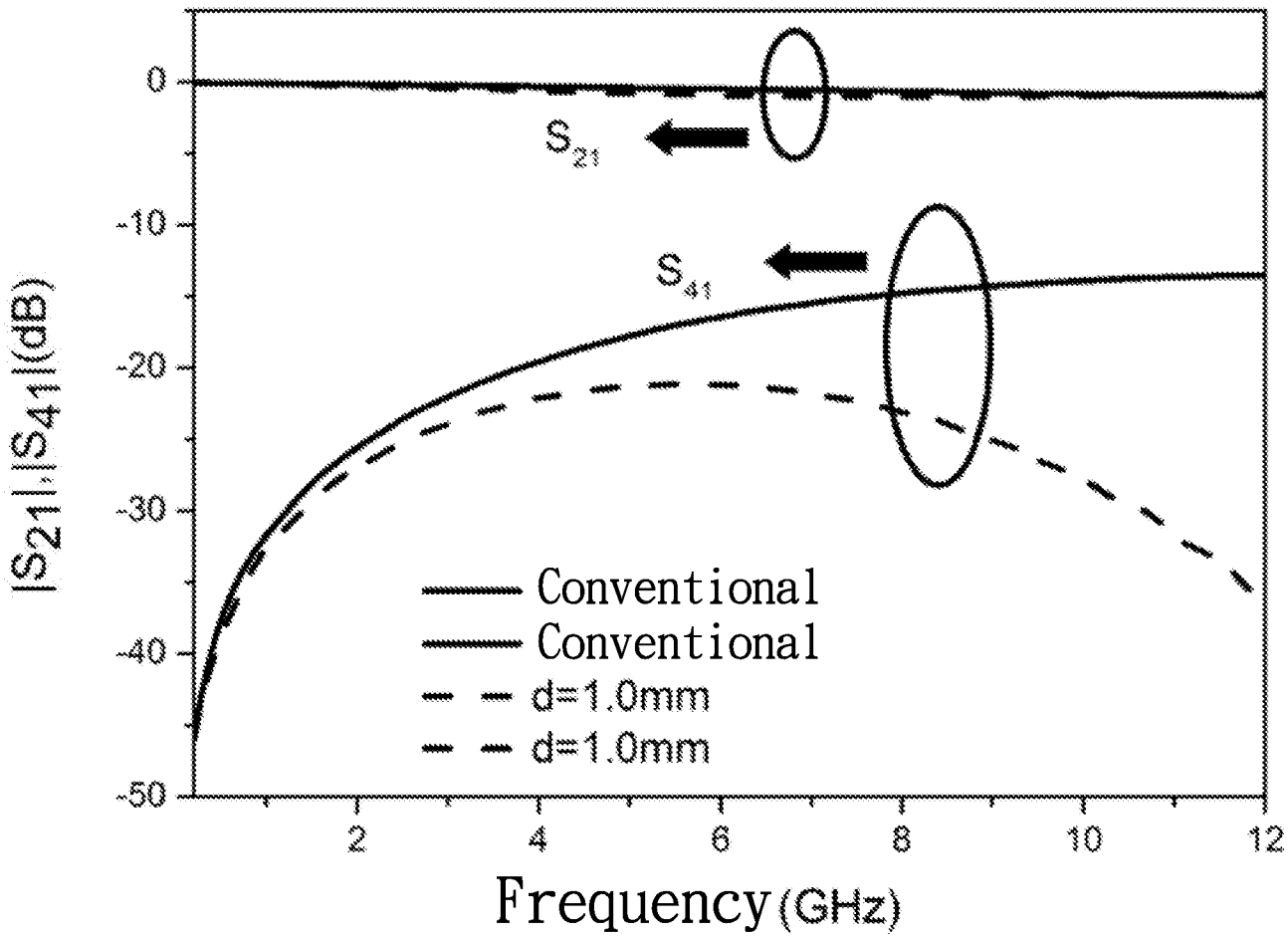
FIG. 16 illustrates a simulation result of seventh embodiment shown in FIG. 9, wherein the microstrip isolation structure having indentation structures with rectangle recesses and rectangle projections is arranged between two transmission line.

The present invention provides exemplary simulation graph shown in FIG. 16 which illustrates crosstalk elimination result respectively in circuit having microstrip isolation structure and circuit without microstrip isolation structure, wherein parameter S represents the simulation of crosstalk elimination effect. It is noted that the microstrip isolation structure utilized to simulate the crosstalk elimination shown in FIG. 16 is the structure shown in FIG. 9 wherein a plurality of indentation structures having rectangle recesses 15 and rectangle projections 16 are formed at the two lateral sides of the microstrip line arranged between two microstrip transmission lines. The plurality of indentation structures has a subwavelength configuration arrangement whereby the crosstalk effect between the upper and lower microstrip transmission lines can be eliminated. In the layout shown in FIG. 9, the dielectric constant $\in_r$ is 3.55, the width of the microstrip line 11 is 1.64 mm, the interval notated as $W_1$ and $W_2$ between the microstrip line 11 and the upper and lower transmission lines is 1.64 mm, the period length d of the indentation structures is equal to 1.0 mm which is twice of the width "a" of the rectangle recess 15 or projections 16, the depth "b" of the rectangle recess is 0.492 mm, the thickness "t" of the metal layer is 0.035 mm and the thickness "h" of the substrate is 0.73 mm. In the FIG. 9, one resistor 55 is connected to one end of the microstrip line 11, and the other resistor 55 is connected to the other end of the microstrip line 11. The two ends of the upper transmission line 11 are connected to first terminal 61 and second terminal 62, respectively.

In the FIG. 16, $S_{21}$ represents the transmission coefficient transmitted from the first terminal 61 to second terminal 62 while $S_{41}$ represents the transmission coefficient of the crosstalk from the first terminal 61 to fourth terminal 64 between the upper microstrip transmission line 11 and lower microstrip transmission line 11. From the simulation result shown in FIG. 16, there has no significant difference between the microstrip transmission lines having microstrip isolation structure disposed there between, and microstrip transmission lines without microstrip isolation structure when the frequency of $S_{21}$ varies from 0-12GHz; however, FIG. 16 shows that the arrangement of the microstrip isolation structure has obvious improvement on elimination of the crosstalk notated as $S_{41}$. Taking the frequency at 12 GHz as an example, when there has no microstrip isolation structure arranged between the two microstrip transmission lines 11, illustrated as the solid line curve shown in FIG. 16, the $S_{41}$ is −13.56 dB; however, when there has microstrip isolation structure arranged between the two microstrip transmission lines 11, illustrated as the dash line curve shown in FIG. 16, the $S_{41}$ is −36.2667 dB. Accordingly, it is clear that the microstrip isolation structure has remarkable effect on eliminating the crosstalk effect induced between the two microstrip transmission lines 11.

Figure 17:
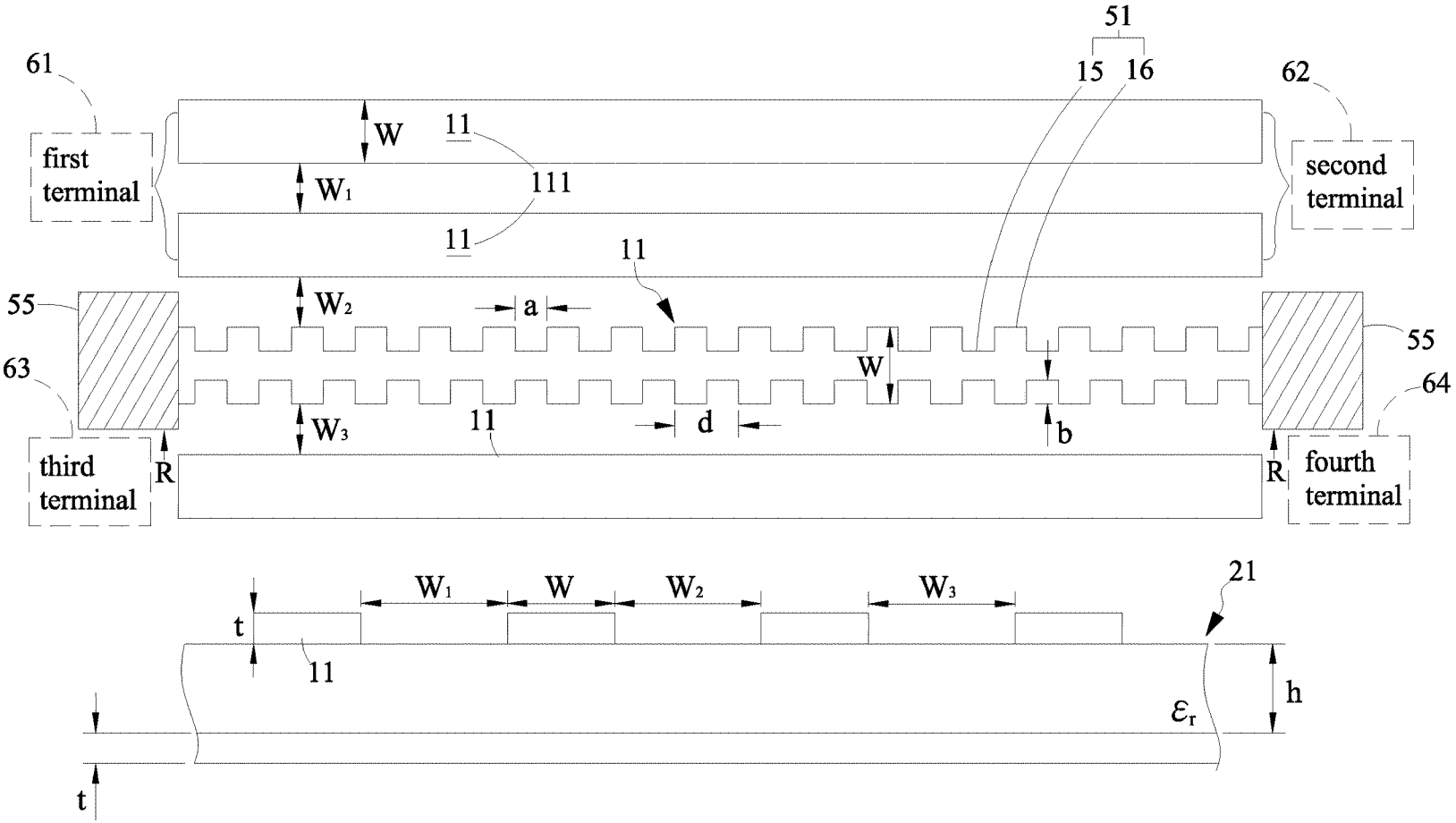
FIG. 17 illustrates a top and a lateral views of a fourteenth embodiment of the microstrip isolation structure having indentation structures formed by rectangle recesses and rectangle projections wherein the microstrip isolation structure is arranged between a differential pair of microstrip transmission lines and a single microstrip transmission line.
Figure 18:
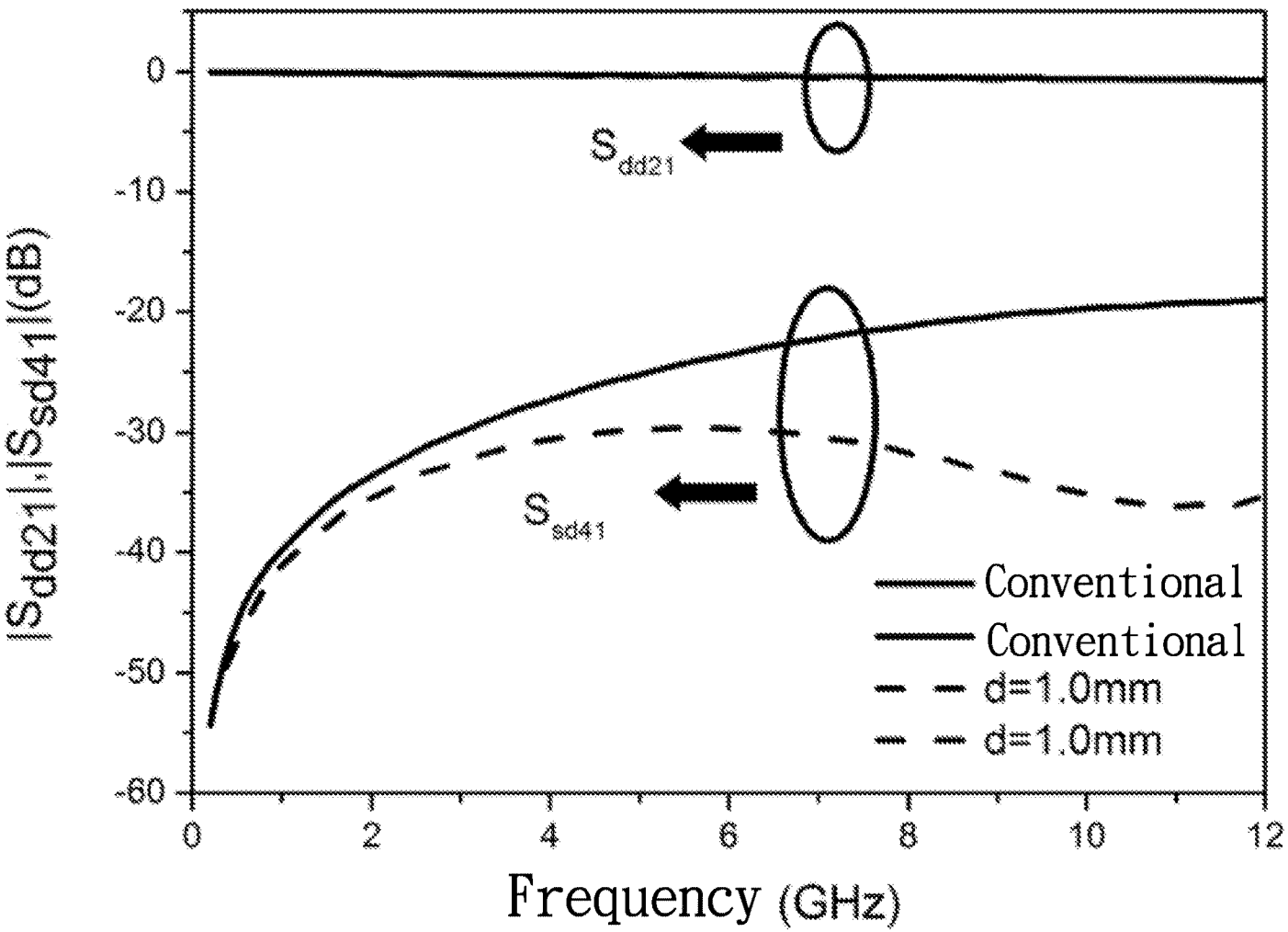
FIG. 18 illustrates a simulation result of S parameter of the microstrip isolation structure shown in FIG. 17 wherein the microstrip isolation structure is arranged between a differential pair of microstrip transmission lines and a single microstrip transmission line.

The present invention provides alternative exemplary simulation graph shown in FIG. 18 which illustrates crosstalk elimination result respectively in circuit having microstrip isolation structure and circuit without microstrip isolation structure, wherein parameter S represents the simulation of crosstalk elimination effect. It is noted that the microstrip isolation structure utilized to simulate the crosstalk elimination result shown in FIG. 18 is the structure shown in FIG. 17 wherein the microstrip isolation structure has the subwavelength configuration for eliminating crosstalk effect between the differential microstrip transmission pair arranged above the microstrip isolation structure and single microstrip transmission line arranged below the microstrip isolation structure. It is noted that the material for making the circuit layout and microstrip isolation structure shown in FIG. 17 is the same as the circuit layout as well as the microstrip isolation structure shown in FIG. 9.

In the embodiment shown in FIG. 17, the differential microstrip transmission pair 111 has two microstrip transmission lines 11 wherein one microstrip transmission line 11 (first transmission line) transmits a first transmission signal and the other microstrip transmission line 11 (second transmission line) transmits a second transmission signal. The first and second transmission signals are complementary signals having 180 degree phase difference from each other. A first terminal 61 is connected to one end of the differential microstrip transmission pair, while the second terminal 62 is connected to the other end of the differential microstrip transmission pair. A third terminal 63 is connected to one end of the microstrip transmission line 11 below the microstrip isolation structure and a fourth terminal 64 is connected to the other end of the microstrip transmission line 11. In the present embodiment shown in FIG. 17, it is noted that the interval $W_1$ between the first and second microstrip transmission lines, the interval $W_2$ between the second microstrip transmission line and microstrip isolation structure, and the interval $W_3$ between the microstrip isolation structure and lower microstrip transmission line 11 are the same as each other and the value thereof is 1.64 mm. The simulation result of the crosstalk elimination about the circuit layout having the differential microstrip transmission pair and the single microstrip transmission line is shown in FIG. 18.

In the FIG. 18, $S_{dd21}$ represents the transmission coefficient transmitted from the first terminal 61 to second terminal 62 in the differential microstrip transmission pair including first and second transmission lines while $S_{sd41}$ represents the transmission coefficient of the crosstalk from the first terminal 61 to fourth terminal 64 between the upper differential microstrip transmission pair 111 and lower microstrip transmission line 11. From the simulation result shown in FIG. 18, there has no significant difference between the circuit layout having microstrip isolation structure disposed between the upper differential microstrip transmission pair and lower microstrip transmission line, and the circuit layout without microstrip isolation structure between the upper differential microstrip transmission pair and lower microstrip transmission line when the frequency of $S_{dd21}$ varies from 0-12 GHz; however, FIG. 18 shows that the arrangement of the microstrip isolation structure has obvious improvement on elimination of the crosstalk notated as $S_{dd41}$ Taking the frequency at 12 GHz as an example, when there has no microstrip isolation structure arranged between the upper differential microstrip transmission pair 111 and lower microstrip transmission line 11, illustrated as the solid line curve shown in FIG. 18, the $S_{dd41}$ is −18.99 dB; however, when there has microstrip isolation structure arranged between upper differential microstrip transmission pair 111 and lower microstrip transmission line 11, illustrated as the dash line curve shown in FIG. 18, the $S_{dd41}$ is −35.37 dB. Accordingly, it is clear that the microstrip isolation structure has remarkable effect on eliminating the crosstalk induced between the upper differential microstrip transmission pair 111 and lower microstrip transmission line 11.

While the present invention has been particularly shown and described with reference to a preferred embodiment, it will be understood by those skilled in the art that various changes in form and detail may be without departing from the spirit and scope of the present invention.

What is claimed is:

1. A microstrip isolation structure for reducing crosstalk, comprising:

a microstrip line, comprising a plurality of indentation structures arranged periodically, wherein each indentation structure is a comb structure having a recess and a Z-shaped projection, and each Z-shaped projection comprises:

a projection body;

a first extension part, connected to the projection body, wherein the first extension part is extended toward a first side of the Z-shaped projection; and a second extension part, connected to a middle section of the projection body, wherein the second extension part is extended toward a second side of the Z-shaped projection;

wherein an extending direction of the first extension part is opposite of an extending direction of the second extension part; and two grounded resistors, connected to two ends of the microstrip line, respectively;

wherein the plurality of indentation structures are periodically arranged in a subwavelength configuration that a period length of the plurality of indentation structures is smaller than a wavelength of a transmission signal generated by a crosstalk around the microstrip line, and impingement of an electromagnetic wave from at least an electrical signal transmission element at one side of the microstrip isolation structure to another electrical signal transmission element at the other side of the microstrip isolation structure is isolated by the plurality of indentation structures; and wherein the plurality of indentation structures having the subwavelength configuration are formed along a single side of the microstrip line or two lateral sides of the microstrip line.

2. The structure of claim 1, wherein the two resistors are impedance matched with the microstrip line.

3. A microstrip isolation structure for reducing crosstalk, comprising:

a microstrip line, comprising a plurality of indentation structures arranged periodically, wherein the plurality of indentation structures are configured by a plurality of recesses and a plurality of J-shaped projections periodically spaced and alternately spaced, and each J-shaped projection has a hook part extending toward the microstrip line; and two grounded resistors, connected to two ends of the microstrip line, respectively;

wherein the plurality of indentation structures are periodically arranged in a subwavelength configuration that a period length of the plurality of indentation structures is smaller than a wavelength of a transmission signal generated by a crosstalk around the microstrip line, and impingement of an electromagnetic wave from at least an electrical signal transmission element at one side of the microstrip isolation structure to another electrical signal transmission element at the other side of the microstrip isolation structure is isolated by the plurality of indentation structures; and wherein the plurality of indentation structures having the subwavelength configuration are formed along a single side of the microstrip line or two lateral sides of the microstrip line.

4. The structure of claim 3, wherein the two resistors are impedance matched with the microstrip line.

* * * * *